United States Patent [19]

Stede et al.

[11] Patent Number: 4,815,636

[45] Date of Patent: Mar. 28, 1989

[54] HOT MELT GUN

[75] Inventors: Manfred Stede, Ranstadt; Holger Schreiber, Homburg; Joachim Speisebecher, Oberursel, all of Fed. Rep. of Germany

[73] Assignee: USM Corporation, Farmington, Conn.

[21] Appl. No.: 616,172

[22] Filed: Jun. 1, 1984

[30] Foreign Application Priority Data

Jun. 3, 1983 [DE] Fed. Rep. of Germany ..... 3320041

[51] Int. Cl.[4] ..... B67D 5/62

[52] U.S. Cl. ..... 222/146.5; 222/391

[58] Field of Search ..... 222/146.5, 391; 403/24, 403/353, 154; 339/196 R, 208

[56] References Cited

U.S. PATENT DOCUMENTS

| | | | |
|---|---|---|---|
| 3,462,179 | 8/1969 | Hinkle | 403/353 |
| 3,743,142 | 7/1973 | Elliott et al. | 222/146.5 |
| 4,009,507 | 3/1977 | Lascarrou | 403/353 |
| 4,027,096 | 5/1977 | Waddington et al. | 339/208 |
| 4,289,257 | 9/1981 | Herb et al. | 222/146.5 |
| 4,378,076 | 3/1983 | Stirnweiss | 222/146.5 |
| 4,471,888 | 9/1984 | Herb et al. | 222/391 |

FOREIGN PATENT DOCUMENTS

| | | |
|---|---|---|
| 2249033 | 4/1973 | Fed. Rep. of Germany . |
| 2265644 | 2/1984 | Fed. Rep. of Germany . |
| 2082852 | 3/1982 | United Kingdom . |

*Primary Examiner*—Joseph J. Rolla
*Assistant Examiner*—Gregory L. Huson
*Attorney, Agent, or Firm*—Thomas S. Szatkowski

[57] ABSTRACT

Hot melt guns comprising a melt body having a melt chamber and a mechanism for feeding a rod of solid hot melt material to the chamber for melting and dispensing. The feeding mechanism comprises a carriage mounted for movement towards and away from the melt body, a clamp member pivotally mounted on the carriage and a trigger to cause the clamp member to grip the rod and feed it into the melt chamber. The clamp member has two pivot pins projecting from opposite sides, each pin having an arcuate coaxial bearing portion and at least one flat face. The pins are received in bearing openings defined by circular bearing surfaces in the carriage, Assembly openings are provided in each bearing surface extending around a minor arc and sufficiently wide for the pins to pass through when the flat faces are suitably oriented relative to the openings. However, when the gun is fully assembled, the arc of movement of the clamp member is restricted so that the pins cannot reach an orientation where the faces are sufficiently aligned with the assembly openings to permit the pins to be withdrawn.

10 Claims, 2 Drawing Sheets

HOT MELT GUN

BACKGROUND OF THE INVENTION

This invention relates to a hot melt gun comprising a melt body having a melt chamber and feeding means for feeding a rod of hot melt material in solid form, under the control of an operator, into the melt chamber. The feeding means comprises a carriage mounted for movement towards and away from the melt body, a clamp member pivotally mounted on the carriage and a trigger connected to the clamp member by connecting means. As pressure is applied to the trigger by the operator the clamp member pivots into engagement with the rod of hot melt material supported by the carriage to grip the rod and, on further pressure on the trigger by the operator, to feed the rod into the melt chamber.

Hot melt guns as described above are known. Such guns are described in German patent specifications Nos. 2249033 and 2265644. Suitable hot melt materials include glues, for sticking together various articles, and sealants. Rods of hot melt material for this purpose are commercially available, for example from the Assignee of the present Application. While such guns have proved reasonably satisfactory in operation, feeding means of the guns described in said specifications have a multiplicity of parts making rapid assembly inconvenient.

SUMMARY OF THE INVENTION

The hot melt gun of the present invention comprises a carriage, clamp member, connecting means, trigger, and a spring biasing the clamp member away from the rod of hot melt and the carriage away from the melt body, all constructed so that they can be conveniently and rapidly assembled to one another and into the gun body without additional equipment or fastening means.

According to the present invention, assembly is also facilitated by the arrangement by which the clamp member engages the carriage. The clamp member has two coaxial pivot pins integral with and projecting outwardly from opposite sides of the clamp member. Each pivot pin has an arcuate coaxial bearing portion and at least one chordal flat face. The pivot pins are received in coaxial bearing openings at opposite sides of the carriage, the bearing openings being defined by substantially circular bearing surfaces against which the bearing portions of the pins are supported. Each bearing surface has an assembly opening extending around a minor arc in the surface remote from a rod of hot-melt supported by the carriage. The assembly openings are sufficiently wide for the pivot pins to easily pass through the assembly openings when the flat faces of the pins are suitably oriented relative to the assembly openings, i.e. with the flat faces generally parallel to a radius of the bearing openings bisecting the assembly openings. However, when assembled in the gun the arc of pivotal movement of the clamp member is restricted so that the pivot pins cannot reach an orientation where the flat faces are sufficiently aligned with the assembly openings to permit the pins to be withdrawn through the openings.

Details relating to the hot melt guns of this invention as well as the advantages derived from such hot melt guns will be more fully appreciated from the Detailed Description of the Preferred Embodiments taken in connection with the Drawings.

DETAILED DESCRIPTION OF THE PREFERRED EMBODIMENTS

Figure 1:
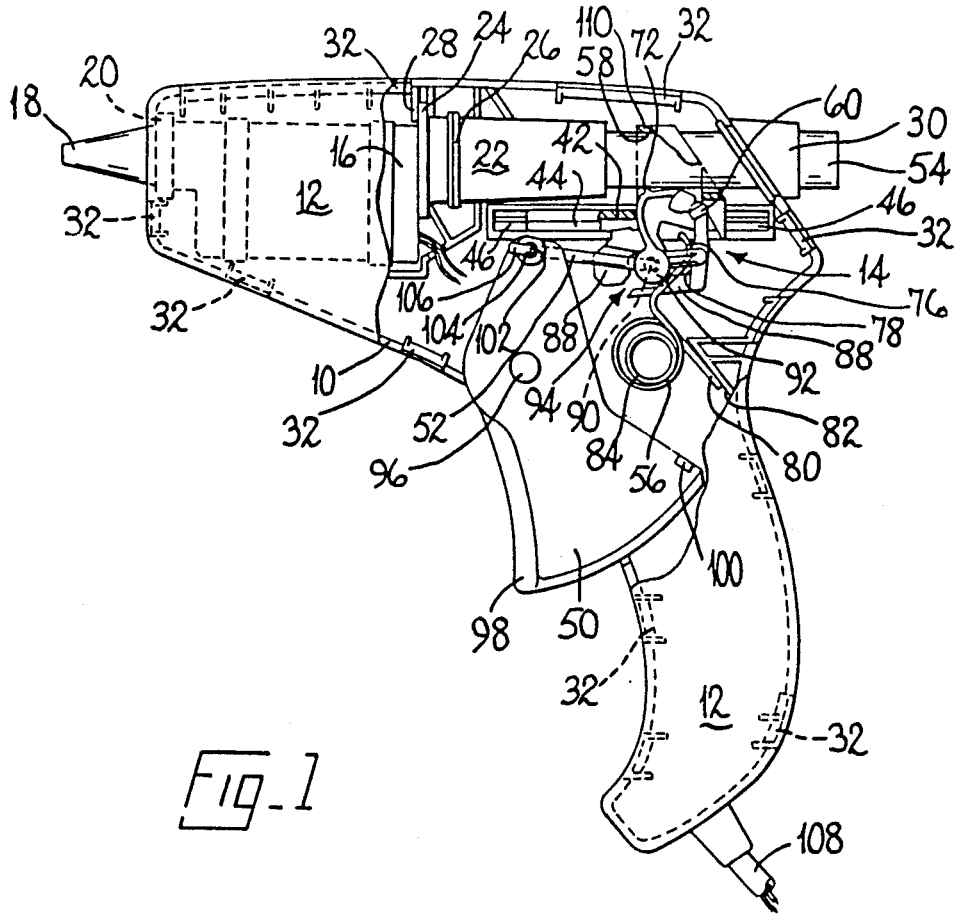
FIG. 1 is a plan view of the illustrative hot melt glue gun with part of a body of the gun broken away to show feeding means.

The illustrative hot melt gun shown in FIG. 1 comprises a body having two parts, 10 and 12. Part 12 of the body is broken away to show feeding means 14, and other parts (described below) of the gun. As well as the feeding means the gun includes a melt body 16 in which is formed a melt chamber (not shown) of suitable configuration, for example having a conically tapering passage extending from an inlet end to nozzle 18 through which molten hot melt is expelled from the melt chamber. Melt body 16 further includes a heater chamber (not shown) normally substantially parallel with the melt chamber and having therein a suitable heating element, for example a so-called positive temperature coefficient heating element (PTC), in good thermal contact with melt body 16. Nozzle 18 may be cast integrally with melt body 16 or provided as a separate, detachable nozzle. Nozzle 18 may contain a valve, e.g. a ball valve, to prevent leakage of melt from the melt chamber when the gun is not in use. Heat insulating washer 20 surrounds the outlet end portion of the melt chamber adjacent the nozzle. Inlet sleeve 22, having flange 24 in contact with melt body 16, may be received on an inlet tube (not shown) projecting rearwardly from melt body 16 and maintained in place on the tube by clip 26. Washer 20 and flange 24 are received in positioning recesses provided by moldings on parts 10 and 12 of the gun body so that the body is spaced from and insulated from melt body 16. Inlet sleeve 22 has an inlet passage, coaxial with the melt chamber, through which rod 54 of hot melt material, for example, an adhesive or sealant, is introduced into the inlet end of the melt chamber. Guide collar 30, mounted in the body of the gun at the rear, provides a guide opening therethrough coaxial with the melt chamber to guide rod 54 of hot melt material and maintain the rod properly aligned with the melt chamber. Inlet sleeve 22 and guide collar 30 are preferably made of silicone rubber. Inlet sleeve 22, in addition to guiding the rod of hot melt material into the melt chamber, forms a seal with the rod, guarding against escape of molten hot melt material from the chamber.

Figure 4:
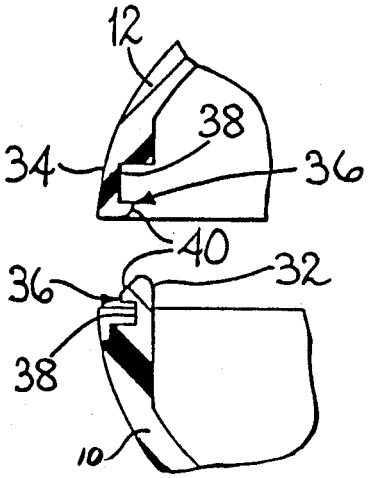
FIG. 4 is a fragmentary cross-sectional view showing a pair of clip members of clip means of the body positioned for assembly of the two parts of the body.

Parts 10 and 12 of the gun body are preferably molded of a tough plastic material. Parts 10 and 12 of the body maybe clipped together by clip means positioned so that access to the interior of the gun body is prevented and so that parts 10 and 12 of the body cannot be separated after assembly without damaging the body. The clip means of the illustrative gun comprises a plurality of cooperating pairs of clip members 32 and 34, one member on either body part 10 and 12, as shown in FIG. 4. Each clip member 32 or 34 includes a hooked end portion 36 adapted to be received, when parts 10 and 12 of the gun body are assembled, in recess 38 of associated clip member 34 or 32. Recesses 38 of clip members 32 are in the exterior of body part 10 and recesses 38 of clip members 34 are in the interior of body part 12. Each hooked end portion 36 of clip members 32 and 34 includes inclined face 40 which, as the body parts 10 and 12 are pressed together during assembly to engage the clip members, slide over one another to cam clip members 32 and 34 respectively inwardly and outwardly so that hooked end portions 36 slide past one another and snap into recesses 38. Recesses 38 are sufficiently deep and hooked end portions 36 engage sufficiently deeply therein so that prying apart of clip members 32 and 34 is effectively prevented.

Figure 2:
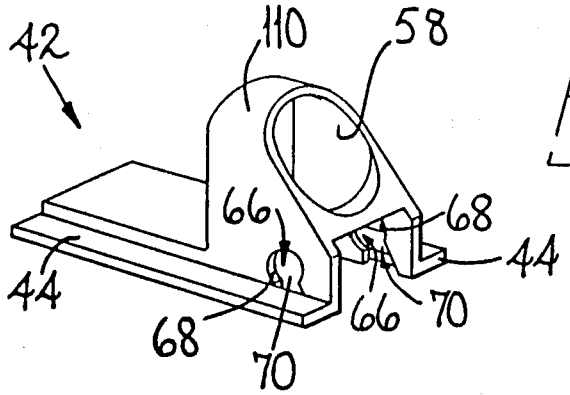
FIG. 2 is a perspective view of a carriage of the feeding means.
Figure 3:
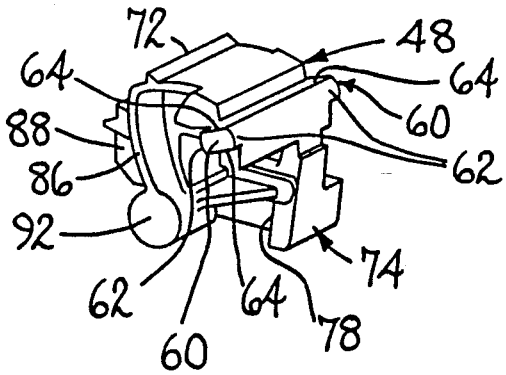
FIG. 3 is a perspective view of a clamp member of the feeding means.

Feeding means 14 feeds rod 54 of hot melt material in solid form, under the control of an operator, into the melt chamber. Feeding means 14 (FIG. 1) of the illustrative gun includes carriage 42 (FIGS. 1 and 2) mounted for sliding movement toward and away from melt body 16. Flanges 44 of the carriage engage in slideways 46 (FIG. 1) molded in gun body parts 10 and 12 and parallel with the axis of the melt chamber. Feeding means 14 further includes a clamp member such as knife member 48 (FIGS. 1 and 3) mounted on carriage 42, and trigger 50 (FIG. 1) connected to knife member 48 by connecting means including link 52. Trigger 50 is arranged to be operated by the operator to pivot knife member 48 into engagement with rod 54 of solid hot melt material supported by carriage 42, inlet sleeve 22, and guide collar 30. Knife member 48 grips rod 54 and, on further pressure on trigger 50 by the operator, feeds rod 54 into the melt chamber. Feeding means 14 also includes a spring such as coil spring 56 by which knife member 48 is biased in a counter-clockwise direction (viewing FIG. 1) and by which carriage 42 is biased away from melt body 16. Feeding means 14 comprising carriage 42, knife member 48, link 52, trigger 50, and spring 56 are constructed in such a way that the parts can all be assembled to one another and into parts 10 and 12 of the gun body without additional equipment or fastening means. Feeding means 14 has been designed to have as few parts as possible, compared for example with the above-mentioned patent specifications, and to be assembled reliably and simply in such a way that when parts 10 and 12 of the gun body are snapped together the feeding means remains securely assembled, as will become apparent from the description following.

Carriage 42 and knife member 48 may both be cast from a suitable metal. Part 110 of carriage 42 (FIGS. 1 and 2) includes guide aperture 58 through which rod 54 passes with a small clearance. The rod is thus supported by part 110. Knife member 48 is pivoted on carriage 42 by means of two coaxial pivot pins 60 (FIGS. 1 and 3) integral with knife member 48 and projecting outwardly from opposite sides of the knife member.

Each pin 60 has an arcuate bearing portion and at least one chordal flat face. Preferably each pin 60 has two parallel flat faces 64 at opposite sides of the pin, the arcuate bearing portion being in two parts separated by the flat faces. Pivot pins 60 are arranged to be received in coaxial bearing openings 66 at opposite sides of carriage 42. Bearing openings 66 are defined by substantially circular bearing surfaces 68 against which bearing portions 62 of pins 60 are supported. Each bearing surface 68 has assembly opening 70 extending around a minor arc in the surface remote from rod 54 of hot melt supported by carriage 42. Assembly openings 70 are sufficiently wide for pivot pins 60 to pass through the assembly openings when flat faces 64 of the pins are suitably oriented relative to the assembly opening (i.e. with the flat faces generally parallel to a radius of bearing openings 66 bisecting the assembly openings). However, when assembled in the gun, the arc of pivotal movement of knife member 48 is restricted so that pivot pins 60 cannot reach an orientation where flat faces 64 are sufficiently aligned with assembly opening 70 to permit the pins to be withdrawn, or escape, through the assembly opening.

As mentioned above, feeding means 14 includes coil spring 56 arranged to bias knife 72 of knife member 48 away from rod 54 and to bias carriage 42 away from melt body 16. Knife member 48 includes projecting portion 74 projecting downwardly below a plane in which knife 72 of knife member 48 and the axis of pivot pins 60 lies. Curved end portion 76 of the spring 56 is received in pocket 78 at the rear of projecting portion 74. End portion 80 of coil spring 56, remote from curved end portion 76, bears on face 82 provided on one part, e.g. part 10 of the gun body. Part 10 of the body further comprises peg 84 around which spring 56 is coiled. When parts 10 and 12 of the gun body are assembled, spring 56 is retained on peg 84 by engagement of peg 84 in a socket (not shown) molded integrally with part 12 of the gun body.

Projecting portion 74 of knife member 48 has a channel between two parts 86 and 88 of projecting portions 74. The channel between parts 86 and 88 is substantially parallel with the path of travel of carriage 42. Link 52 is disposed in the channel between the parts 86 and 88, lying generally parallel with the path of travel of carriage 42. The link has one end portion 90 pivoted in boss 92 of part 86. Part 88 has assembly opening 94 oriented so that link 52 can be introduced through assembly opening 94 to pivot end portion 90 in boss 92. However, when the gun is fully assembled, movement of link 52 is restricted, as will be described below, so that link 52 cannot escape through assembly opening 94. Link 52 of the illustrative gun is preferably in the form of a rigid wire, with end portion 90 bent at right-angles to the main part of the link so that end portion 90 is substantially parallel with the axis of pivot pins 60. The hole in boss 92 in which the end portion 90 is received is also substantially parallel with the axis of pivot pins 60, so that end portion 90 pivots in the boss. Trigger 50 preferably is molded of a suitable plastic material and is pivotally mounted on the body of the gun by means of integrally molded pegs 96 (only one of which is visible in the drawings), which are received in opposed holes in parts 10 and 12 of the gun body to be parallel with the axis of pivot pins 60. Trigger 50 includes pressure plate 98 arranged to be contacted by the finger of an operator to operate trigger 50. The arc of movement of the trigger is restricted by engagement of pressure plate 98 with the gun body and by engagement of stop member 100 (also molded integrally with trigger 50) with parts 10 and 12 of the gun body. Pivot portion 102 of link 52, remote from and parallel with end portion 90, is received in hole 104 in trigger 50 parallel with the hole in boss 90. End part 106 of link 52 extends beyond pivot portion 102, end part 106 lying generally perpendicular to pivot portion 102 to retain the pivot portion in hole 104 in trigger 50.

Power is supplied to the heater element in known manner by cable 108 entering the gun through a handle portion.

Feeding means 14 can be assembled simply: knife member 48 is first assembled with carriage 42 by introduction of pivot pins 60 into bearing openings 66. Link 52 is also assembled with knife member 48, with end portion 90 received in the hole in boss 92, the link being introduced through assembly opening 94 as described above. The assembly including carriage 42, knife member 48 and link 52 is assembled with spring 56 and positioned in part 10 of the body portion with lower (viewing FIG. 1) flange 44 of carriage 42 received in slideway 46 in part 10 and with the spring positioned around peg 84, as shown in FIG. 1. End part 106 of link 52 is then introduced through hole 104 in the trigger and the appropriate peg of the trigger introduced into the hole (not shown) in part 10. When feeding means 14 is assembled, carriage 42 is urged by spring 56 away from the melt body (toward the right, viewing FIG. 1) along slideway 46 and the knife member is urged in a counter-clockwise direction (viewing FIG. 1), so that knife 72 is clear of rod 54. The link is in a position generally parallel with slideway 46. Stop member 100 engages part 10 of the body, preventing further clock-wise movement of the trigger (viewing FIG. 1). The orientation of knife member 48 relative to carriage 42 is such that pins 60 are unable to escape from bearing opening 66 through assembly opening 70 and likewise link 52 is unable to reach an orientation which would allow it to escape from the channel between parts 86 and 88 through assembly opening 94. After feeding means 14 and the other parts of the gun, including melt body 16, inlet sleeve 22, guide collar 30, electric leads and heater element, are properly assembled in part 10 of the gun body, part 12 of the body is aligned with part 10 and the two parts are pressed together so that clip members 32 and 34 snap together to lock body parts 10 and 12 to each other. When part 12 is assembled with part 10, peg 96 of trigger 50 enters a cooperating hole in part 12 and peg 84 of body part 10 is received in the corresponding socket in part 12. Trigger 50 is thus held in place by the two pegs in body parts 10 and 12, and spring 56 is held in position about peg 84 by the socket of body part 12. Upper (viewing FIG. 1) flange 44 is engaged in a slideway (parallel with the slideway of body part 10) in body part 12.

When the trigger is moved in a counter-clockwise (viewing FIG. 1) direction by pressure on pressure plate 98, the knife member is pivoted by link 52 in a clockwise direction to move knife 72 through an opening in carriage 42 into engagement with rod 54. Further pressure on the trigger causes carriage 42 to move towards melt body 16 (toward the left, viewing FIG. 1), engagement of knife 72 with rod 54 causing the rod to be gripped between knife 72 and carriage 42 and moved with the carriage towards the melt chamber. (The feeding means is shown in an intermediate position in FIG. 1.) Continued pressure on pressure plate 98 will rotate trigger 50 in a counter-clockwise direction to a maximum extent governed by contact of pressure plate 98 with body parts 10 and 12. With the trigger in this position, part 110 of the carriage 42 is adjacent the inlet end of inlet sleeve 22. In this most extreme, forward position of feeding means 14, knife member 48 is likewise at an orientation in which pins 60 are unable to escape from bearing openings 66 and link 52 is retained in the channel between parts 86 and 88.

When trigger 50 is released, spring 56 urges knife member 48 in a counter-clockwise direction (viewing FIG. 1) so that knife 72 is moved out of contact with rod 54—which is held against movement rearwardly by collar 30 and inlet sleeve 32. Carriage 42 slides away from the melt body under the pressure of spring 56 to an extent determined by engagement of stop member 100 with body parts 10 and 12, the carriage sliding relative to rod 54 so that, on subsequent operation of the trigger 50, a fresh portion of rod 54 is gripped by knife 72 and part 110 of carriage 42. The illustrated hot melt gun completes the melting operation in known manner: as rod 54 is urged into the melt chamber by feeding means 14, heat supplied to melt body 16 by the heating element melts the material of rod 54, and the molten material is dispensed through nozzle 18 under pressure applied by feeding means 14 to rod 54. Relaxation of pressure on trigger 50 stops feed of rod 54 into the melt chamber and thus molten material ceases to be dispensed through nozzle 18.

The illustrated hot melt gun is, as has been described, simple and quick to assemble and cannot be disassembled without breaking body parts 10 and 12, thus preventing unauthorized access to the inside of the gun, which could prove dangerous. Novel feeding means 14 is especially advantageous in that it consists of few moving parts and is extremely simple to assemble rapidly. Furthermore, body parts 10 and 12, preferably cooperate to retain feeding means 14 in its assembled condition so that because of the ingenious construction of the feeding means, there is no possibility of feeding means 14 becoming disassembled inside the gun body, a problem which has sometimes arisen in previously known designs of trigger-operated hot melt guns.

The hot melt gun shown in FIGS. 1–4 and described above is intended as a non-limiting, illustrative example of the novel hot melt guns of the invention; other embodiments are possible within the scope of the invention. Hot melt guns according to the invention may be adapted for use in the melting and application of various hot melt materials commercially available in the form of solid rods, such as glues and sealants.

We claim:

1. In a hot melt gun comprising a melt body having a melt chamber and feeding means for feeding a rod of hot melt material in solid form, under the control of an operator, into the melt chamber, and in which the feeding means comprises a carriage to support the rod of hot melt material and mounted for movement towards and away from the melt body, a clamp member pivotally mounted on the carriage and a trigger connected to the clamp member by connecting means and arranged to be operated by the operator to pivot the clamp member into engagement with the rod of hot melt supported by the carriage to grip the rod and, on further pressure on the trigger by the operator, to feed the rod into the melt chamber, the improvement wherein:

a. the clamp member comprises two coaxial pivot pins integral therewith and projecting outwardly from opposite sides thereof, each pivot pin having an arcuate coaxial bearing portion and a chordal flat face, and a projecting portion projecting downwardly below a plane in which a knife of the clamp member and the axis of the pivot pin lies, and wherein a portion of a spring is received in a pocket in the projecting portion to bias the knife of the clamp member away from the rod of hot melt and the carriage away from the melt body;

b. the carriage comprises two opposite sides, each side having one of two coaxial bearing openings to receive the pivot pins, the bearing openings being defined by substantially circular bearing surfaces against which the bearing portions of the pins are supported, each bearing surface having an assembly opening extending around a minor arc in the surface remote from the rod of hot melt material supported by the carriage, the width of the assembly openings being slightly larger than the distance between the flat faces of the pivot pins so that, during assembly of the gun, the pivot pins pass through the assembly openings with narrow clearance when the pins are oriented with the flat faces generally parallel to a radius of the bearing openings bisecting the assembly openings, but so that, when the gun is fully assembled, the arc of pivotal movement of the clamp member is restricted and the pivot pins cannot reach an orientation where the flat faces are sufficiently aligned with the assembly openings to permit withdrawal of the pivot pins through the openings.

2. A hot melt gun according to claim 1 wherein the spring is a coil spring in which the end portion remote from the portion received in the pocket bears on a face on a body of the gun and wherein the body of the gun comprises two parts one part of which provides a peg around which the spring is coiled, the spring being retained on the peg by engagement of the peg in a socket on the other part of the body of the gun.

3. A hot melt gun according to claim 1 wherein each pivot pin has two parallel flat faces at opposite sides of the pin, the arcuate bearing portion being in two parts separated by the flat faces.

4. A gun according to claim 1 or 3 wherein a body of the gun comprises two parts which clip together using clip means positioned so that access to the interior of the fully assembled gun is prevented and so that the two parts of the body, when the gun is fully assembled, cannot be separated without damaging the body, the two parts of the body cooperating to retain the feeding means in its assembled condition.

5. A hot melt gun according to claim 4 wherein the clip means comprises a plurality of cooperating pairs of clip members, one member of each pair on either body part; each clip member having a hooked end portion received in a recess of the opposite clip member of the pair, the recess of one clip member being in the interior of one body part and that of the other member in the exterior of the other body part, and each of the hooked end portions having one or more inclined faces which, as the body parts are pressed together to engage the clip members, slide over one another to cam the clip members respectively inwardly and outwardly so that the hooked end portions slide past one another and snap into the recesses, the recesses being sufficiently deep and the hooked end portions engaging sufficiently deeply therein to prevent prying apart of the clip members.

6. A hot melt gun according to claims 1 or 3 wherein the clamp member further comprises a projecting portion projecting downwardly below a plane in which a knife of the clamp ember and the axis of the pivot pins lies, the projecting portion having a channel between two parts thereof, extending parallel with the path of travel of the carriage and in which is disposed a link of the connecting means lying generally parallel with the path of travel of the carriage and having one end portion pivoted in a boss of one of the two parts of the carriage, the other of the two parts having an assembly opening oriented so that, during assembly of the gun, the link can be introduced therethrough to pivot the end portion in the boss, but so that when the gun is fully assembled movement of the link is restricted so that the link cannot escape through the assembly opening.

7. A hot melt gun according to claim 6 wherein the link is in the form of a rigid wire providing the end portion which is bent at right angles to a main part of the link and parallel with the axis of the pivot pins, and is received in hole in the boss.

8. A hot melt gun according to claim 7 wherein the trigger is pivotally mounted on a body of the gun and wherein the link has a pivot portion remote from and parallel with the end portion received in the boss the pivot portion being received in a hole in the trigger parallel with the hole in the boss.

9. A hot melt gun according to claim 8 wherein the link has an end part extending beyond the pivot portion and lying generally perpendicular to the pivot portion to retain the pivot portion in the hole in the trigger.

10. A hot melt gun according to claim 9 Wherein the trigger is molded from plastic material and comprises an integrally molded peg received in a hole in the body of the gun parallel with the axis of the pivot pins so that the trigger is pivotally mounted on the body of the gun.

* * * * *